US006109329A

United States Patent [19]

Russo

[11] Patent Number: 6,109,329

[45] Date of Patent: Aug. 29, 2000

[54] MODULAR PANEL STRUCTURE

[76] Inventor: Ralph Russo, 29 Havenbrook Blvd., North York, Ontario, Canada, M2J 1A3

[21] Appl. No.: 09/143,385

[22] Filed: Aug. 28, 1998

[51] Int. Cl.[7] ..... A47G 5/00

[52] U.S. Cl. ..... 160/135; 160/351; 52/731.2; 52/737.4; 52/732.2

[58] Field of Search ..... 160/135, 137, 160/160, 231.2, 229.1, 351, 377, 381; 52/720.1, 729.1, 729.2, 731.1, 731.2, 731.3, 732.2, 737.4, 737.6; 40/124.1; 108/51.3, 56.3

[56] References Cited

U.S. PATENT DOCUMENTS

| | | | |
|---|---|---|---|
| 1,110,093 | 9/1914 | Yauck . | |
| 1,813,873 | 7/1931 | Brogden | 52/729.1 X |
| 2,082,792 | 6/1937 | Dean | 52/729.3 X |
| 3,332,197 | 7/1967 | Hinkle | 52/731.3 |
| 3,571,999 | 3/1971 | Downing . | |
| 3,589,046 | 6/1971 | Taub | 40/124.1 |
| 3,626,653 | 12/1971 | Amirikian | 52/731.3 X |
| 3,717,377 | 2/1973 | Johnson | 297/440 |
| 3,819,188 | 6/1974 | Freedman . | |
| 3,837,721 | 9/1974 | Manlove et al. . | |
| 4,055,019 | 10/1977 | Harvey | 46/30 |
| 4,087,949 | 5/1978 | Hill | 52/309.13 |
| 4,104,885 | 8/1978 | Thomas . | |
| 4,147,198 | 4/1979 | Ytter | 160/135 |
| 4,372,086 | 2/1983 | Hanlon . | |
| 4,556,253 | 12/1985 | Geneve et al. | 297/440 |
| 4,785,565 | 11/1988 | Kuffner . | |
| 4,827,690 | 5/1989 | Viger . | |
| 4,902,259 | 2/1990 | Ziegler . | |
| 4,961,299 | 10/1990 | Sheffield . | |
| 4,989,390 | 2/1991 | Moore, III | 52/720.1 |
| 5,070,665 | 12/1991 | Marrin et al. . | |
| 5,107,652 | 4/1992 | Sosa | 160/135 X |
| 5,183,430 | 2/1993 | Swann . | |
| 5,215,490 | 6/1993 | Szoradi . | |
| 5,364,311 | 11/1994 | Chou | 160/135 X |
| 5,464,302 | 11/1995 | Menchetti | 52/731.1 X |
| 5,524,410 | 6/1996 | Menchetti | 52/729.2 |
| 5,570,971 | 11/1996 | Rixen et al. . | |
| 5,604,949 | 2/1997 | Mangone . | |
| 5,660,119 | 8/1997 | Perkins | 108/51.3 |
| 5,681,641 | 10/1997 | Grigsby et al. | 52/729.1 X |
| 5,848,512 | 12/1998 | Conn | 52/729.1 |
| 5,862,642 | 1/1999 | Erwin | 52/720.2 X |
| 5,960,848 | 10/1999 | Schirer | 160/135 |
| 5,992,071 | 11/1999 | Dahlquist | 160/351 X |

*Primary Examiner*—Bruce A. Lev
*Attorney, Agent, or Firm*—Bereskin & Parr

[57] ABSTRACT

A modular panel having integral connection member for use in display board assemblies. The panels are fabricated from multiple sheets of corrugated board laminated together. A plurality of spaced-apart fingers are provided on a panel for matingly interfitting the panel to an adjacent panel having similar fingers. Several panels of identical or varied configurations may be interconnected to form a suitable display board assembly. A beam element is also provided for use in such assemblies.

16 Claims, 19 Drawing Sheets

MODULAR PANEL STRUCTURE

FIELD OF THE INVENTION

This invention relates to modular elements for use in a temporary wall structure and, more particularly, to panel elements which are both lightweight and easily connectible to corresponding elements.

BACKGROUND OF THE INVENTION

With the recent prevalence of trade shows, there is a need for temporary structures to act as a back drop for display booths and seminars. Given that trade shows are quite temporary, in addition to being sturdy the structure needs to be quick and easy to assemble and disassemble, as well as portable. Past designs, however, have not achieved these goals satisfactorily.

For example, U.S. Pat. No. 4,372,086 to Hanlon discloses a display structure which has the advantage of being lightweight and easy to transport, but lacks durability and sturdiness. Similarly, U.S. Pat. No. 3,571,999 to Downing discloses a display which also lacks a solid attachment means between panels. U.S. Pat. No. 4,785,565 to Kuffner provides a more stable connection means between panels, however connections are both complex to manufacture and not simple to install.

Accordingly, there is a need for a simpler, more portable and easy-to-assemble system for providing temporary structures. It has been discovered that multi-ply corrugated cardboard panels, when treated and finished properly, are particularly well-adapted for use in temporary display structures. Furthermore, a novel integral means of attaching adjacent panels has been devised.

SUMMARY OF THE INVENTION

The present invention offers construction elements for use in trade show displays, point-of-purchase merchandise displays, and other temporary structures, which are lightweight, simple to manufacture, easy to assemble, portable, reusable and recyclable.

In a first aspect the invention provides a panel assembly comprising:

a first panel connected to a second panel, said first and second panels each having a body made of corrugated board, said body having a front face and a back face, said corrugated board defining a plurality of parallel flutes disposed between said front face and said back face, and a plurality of fingers and notches alternately defined in said body to define a connecting side, said fingers and said notches being aligned along an axis that is coaxial with at least one of said flutes; and at least one pin for securing said first and second panels together;

wherein said first panel is connected to said second panel with said fingers and said notches interfitting with each other, and wherein said flutes define at least one through channel between said interfitted fingers and notches, and wherein said at least one pin extends at least partly through said at least one through channel to secure together at least some of said interfitted fingers and notches.

In a second aspect the invention provides a panel assembly kit comprising:

a plurality of panels, said panels having a body made of corrugated board, said body having a front face and a back face, said corrugated board defining a plurality of parallel flutes disposed between said front face and said back face, and a plurality of fingers and notches alternately defined in said body to define a connecting side, said fingers and said notches being aligned along an axis that is coaxial with at least one of said flutes; and a plurality of pins for securing said panels together;

wherein said panels are assembled by interfitting said fingers and said notches of one said panel with said fingers and said notches on another said panel, said flutes defining at least one through channel between at least some of said interfitted fingers and notches for receiving at least one of said pins to secure said panels together.

In a third aspect the invention provides a panel assembly kit comprising:

a plurality of panels each having a body having a front face and a back face; and a plurality of fingers and notches alternately defined in said body to define a connecting side;

wherein said panels are assembled with at least some of said fingers and said notches of adjacent said panels interfitting with each other with said fingers extending through said notches from said front side to said back side so that said fingers overlap said back face and engage a portion of said adjacent panel.

BRIEF DESCRIPTION OF THE DRAWINGS

For a better understanding of the present invention, and to show more clearly how it may be carried into effect, reference will now be made, by way of example, to the accompanying drawings.

The drawings show preferred embodiments of the present invention, in which.

DETAILED DESCRIPTION OF THE PREFERRED EMBODIMENTS

Figure 1:
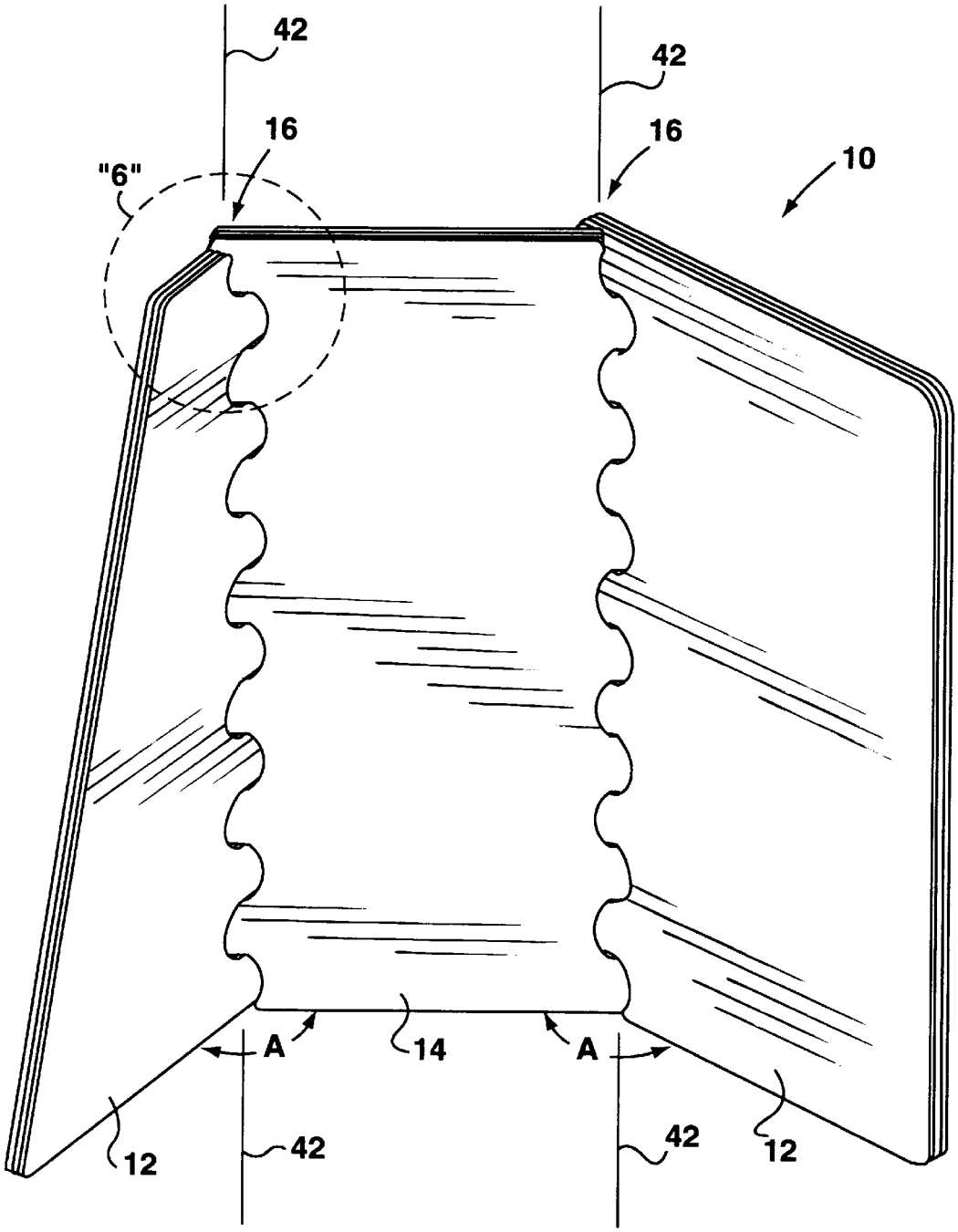
FIG. 1 is an isometric view of an assembly of modular panel elements in accordance with the present invention.
Figure 15:
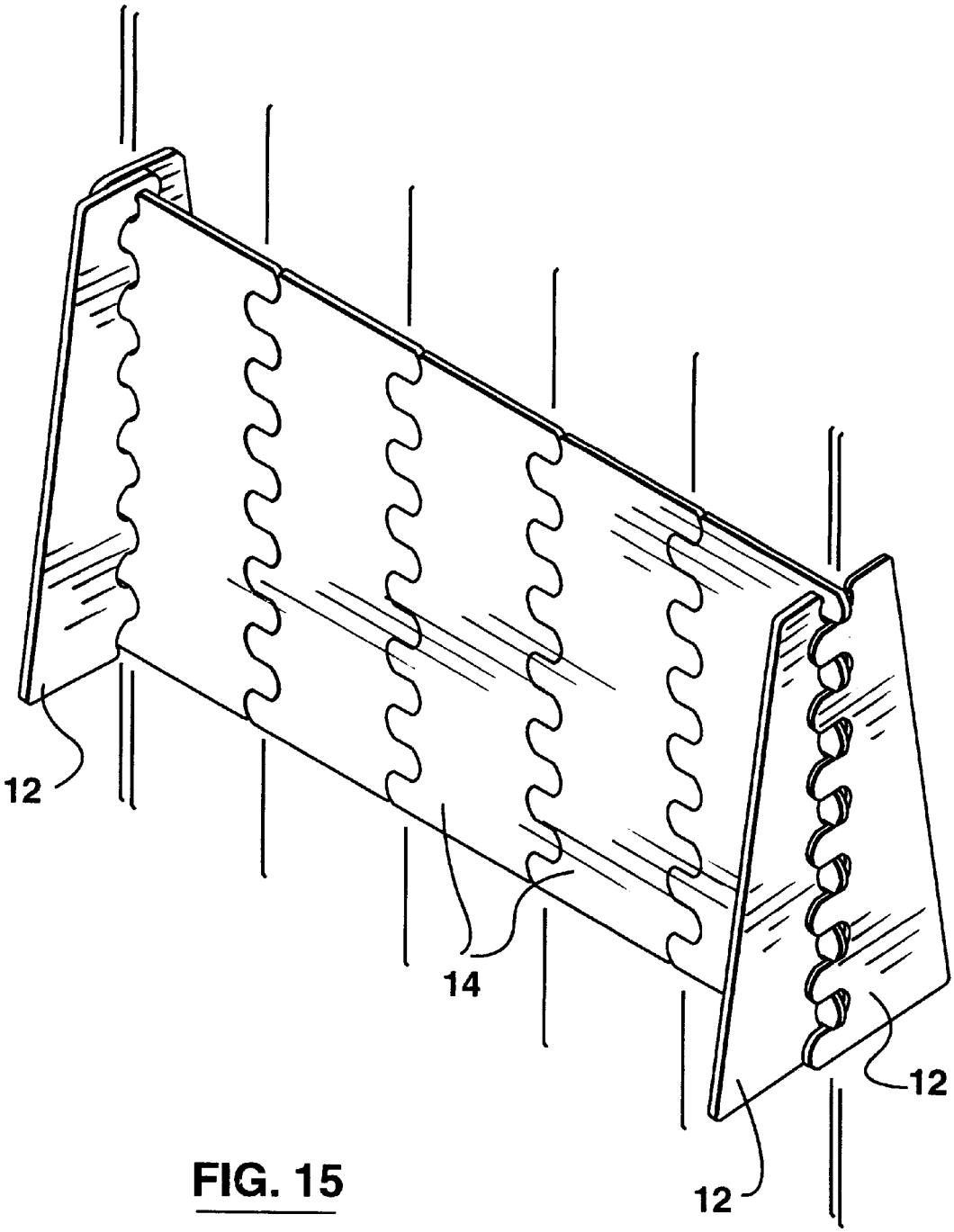
FIG. 15 is an isometric view of a sample arrangement of an assembly of modular panel elements in accordance with the present invention.
Figure 16:
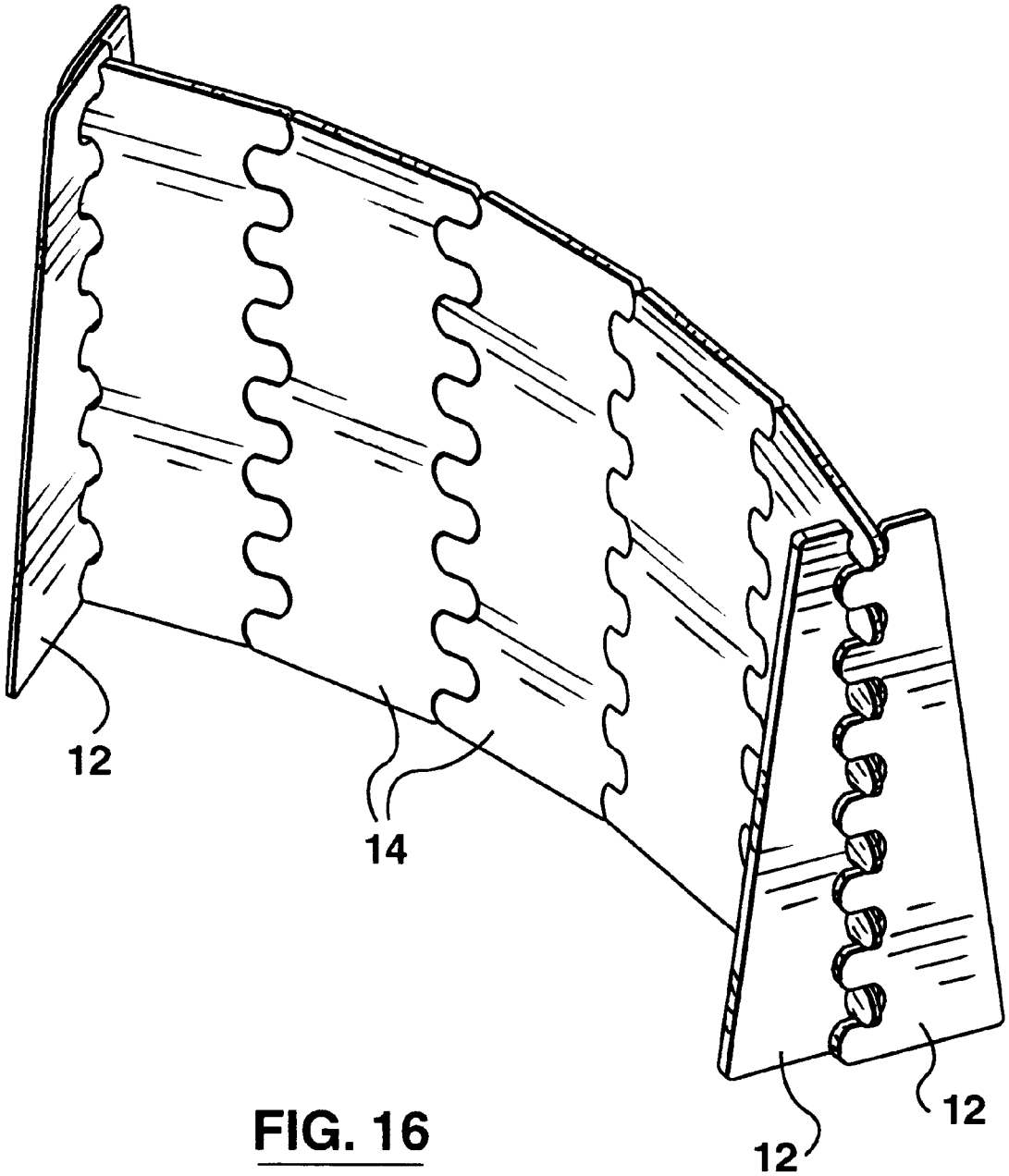
FIG. 16 is an isometric view of a second sample arrangement of an assembly of modular panel elements in accordance with the present invention.
Figure 17:
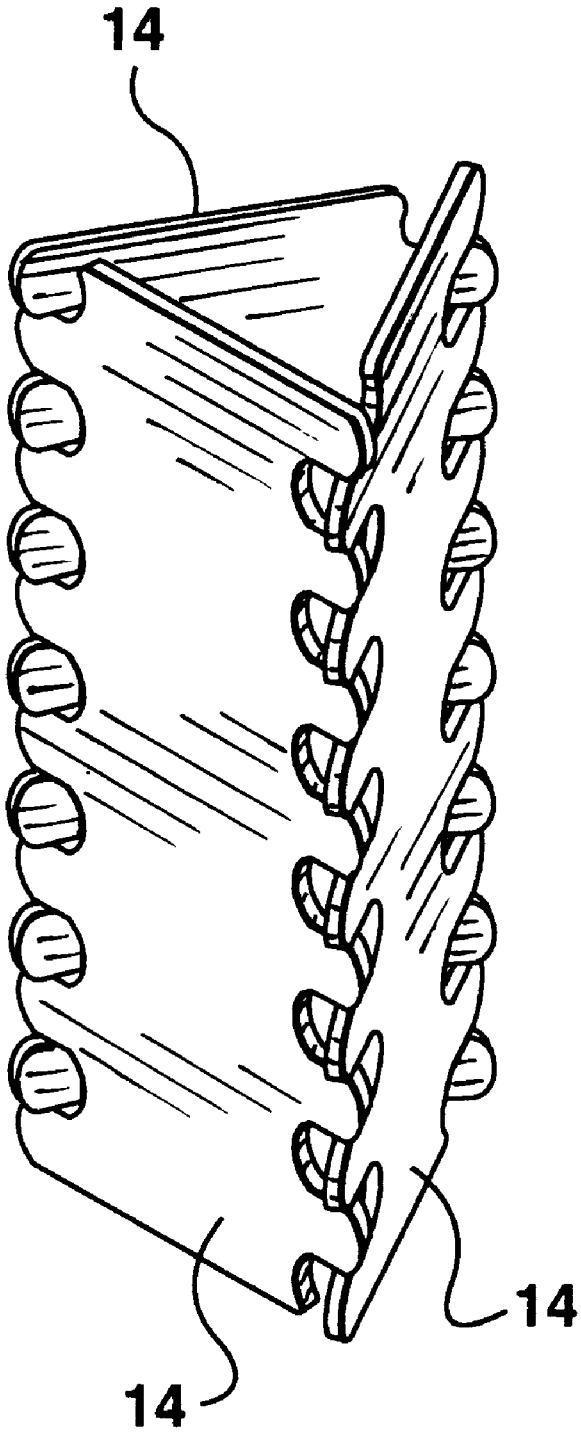
FIG. 17 is an isometric view of a third sample arrangement of an assembly of modular panel elements in accordance with the present invention.
Figure 18:
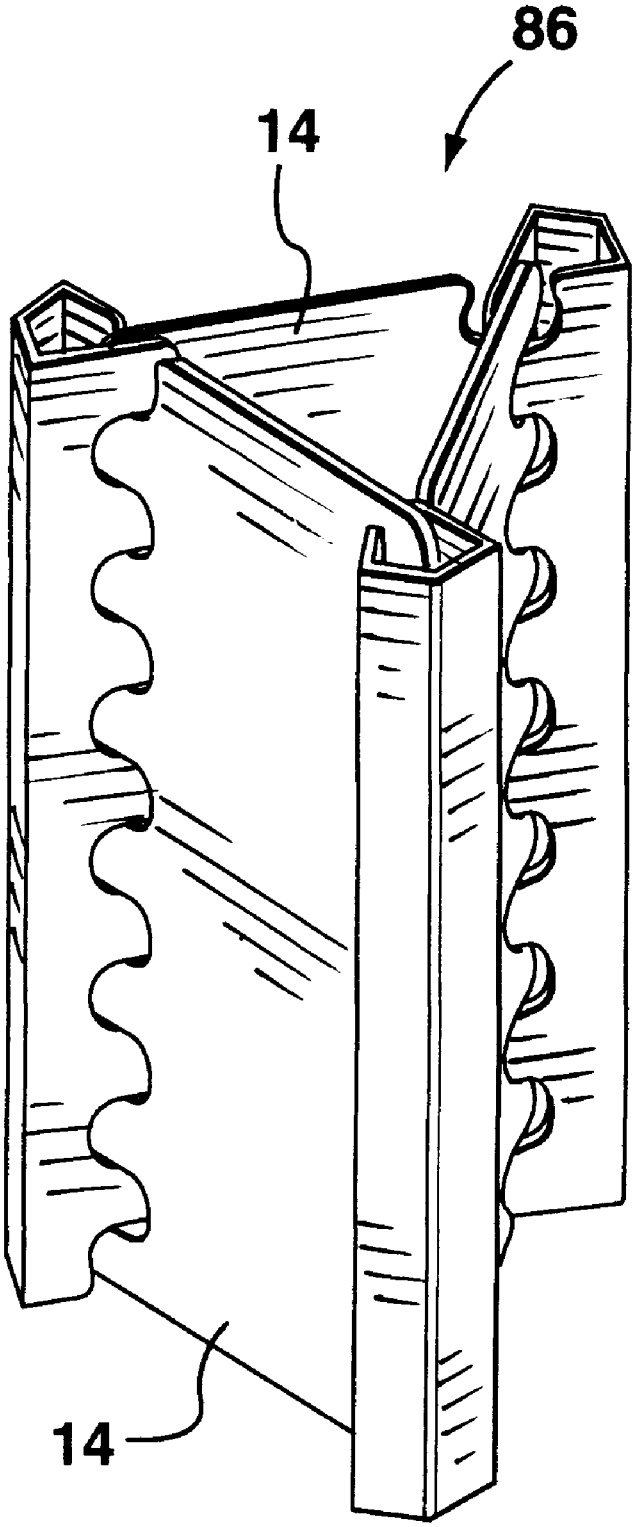
FIG. 18 is an isometric view of a fourth sample arrangement of an assembly of modular panel elements in accordance with the present invention.

A display board assembly incorporating modular panel elements according to the present invention is shown generally at 10 in the figures. Display board assembly 10, in its simplest form, comprises terminal panels 12 and intermediate panel 14. Terminal panels 12 are connected to intermediate panel 14 at connections 16, and are positioned relative to intermediate panel 14 at an angle A. Depending on the manner in which panels 12 and 14 are interfitted, angle A may be varied as desired, as will be discussed further below. For example, angle A may be any angle, including 180° (ie. a planar alignment of panels), as demonstrated in FIG. 15, however an angle A of about 135° or less is generally preferred, especially between an intermediate panel 14 and an terminal panel 12 as shown in FIG. 1, to permit interfitted panels to be self-supporting and free standing, yielding a robust display board assembly 10.

Figure 2:
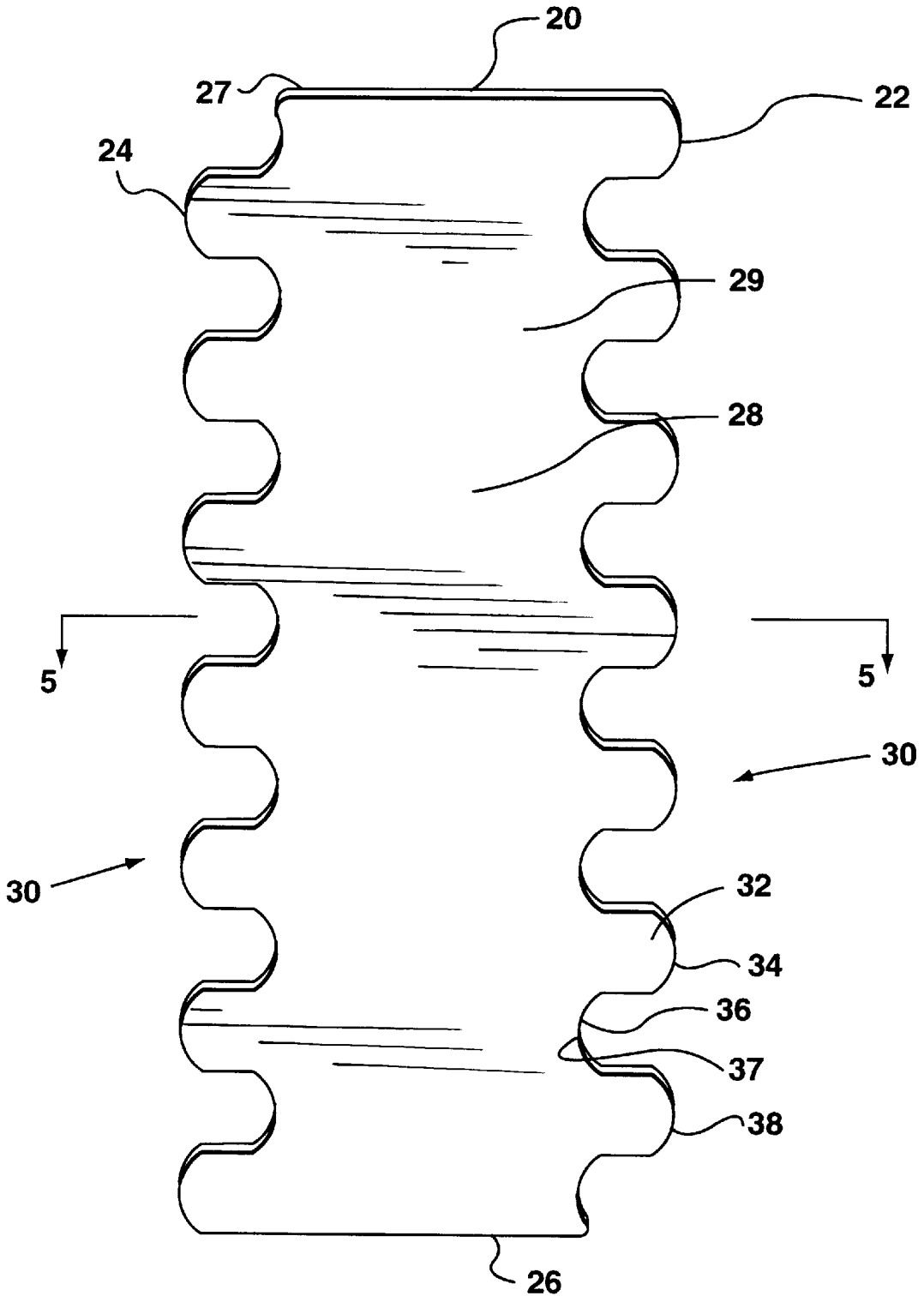
FIG. 2 is a front view of a modular panel element of the assembly of FIG. 1.
Figure 3:
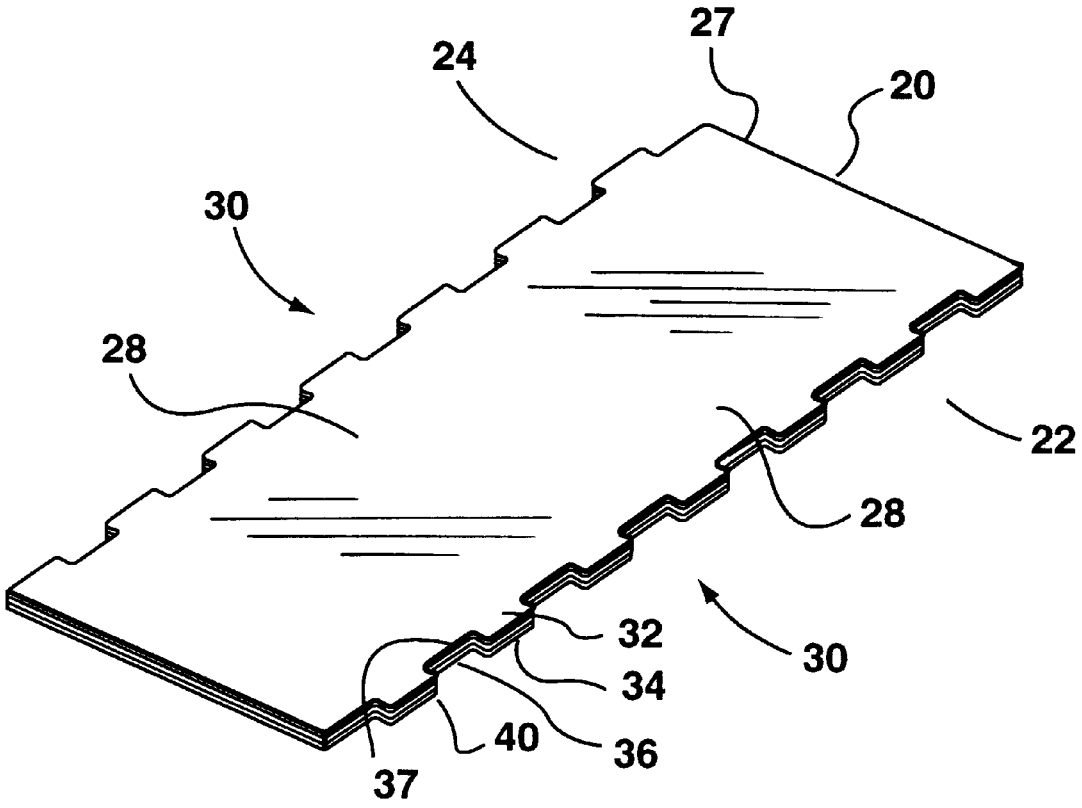
FIG. 3 is an isometric view of an alternate embodiment of the connecting means of the panel of FIG. 2.

Referring to FIG. 2, intermediate panel 14 comprises a top 20, sides 22 and 24, a bottom 26, a back face 27 and a front face 28, and has a central panel or display portion 29 and connecting means 30 along sides 22 and 24. Connecting means 30 comprises a plurality of fingers 32 spaced-apart by slots or notches 36. Fingers 32 have tips 34 and notches 36 have a roots 37. Tips 34 and roots 37 may have a curvilinear profile 38, as shown in FIG. 2, or a rectilinear profile 40, as shown in FIG. 3, or any other desired profile. Preferably, however, a simple profile is chosen to facilitate both manufacture and interconnection of panels 12 and 14.

Fingers 32 on opposing sides 22 and 24 of intermediate panel 14 are preferably offset, ie. a finger 32 on side 22 corresponds to the location of a notch 36 on the opposing side 24. This permits identical adjacent intermediate panels 14 to be interconnected because a finger 32 will be located opposite a notch 36 on an adjacent panel 14 or 12, thereby permitting the fingers 32 to be interfitted.

The number of fingers 32 and notches 36 on a panel is not important, however the following must be considered: fewer fingers 32 and notches 36 will facilitate easier interconnection of the panels (as will be described below) but will also, however, weaken the strength of connection 16, due to a decrease in mating surface area. Accordingly, the number of fingers 32 and notches 36 chosen preferably achieves an optimization of these considerations. In the preferred embodiment, panel 14 is 82" high and has seven (7) fingers 32 and notches 36.

The relative width of fingers 32 and notches 36 are chosen such that when a finger 32 is inserted into a notch 36 of an adjacent panel, finger 32 is slightly smaller, though only slightly smaller, preferably ⅛", than its corresponding notch 36. This permits an easy interfitting of fingers 32 and notches 36, and yet results in a secure connection 16 between adjacent panels. This relative sizing may be conveniently achieved by sizing fingers 32 and notches 36 identically on side 22 of panel 14, while making fingers 32 ⅛" smaller, and notches 36 ⅛" larger, on opposing side 24. For example, in FIG. 2, fingers 32 and notches 36 on side 22 are 5⅞" wide, while on opposing side 24 fingers 32 are 5¾" and notches 36 are 6". It will be apparent, however, that any finger and notch size may be chosen and it is only the relative size between finger 32 and notch 36 which is important. For aesthetic reasons, it is desirable to have all fingers 32 and notches 36 on a panel 14 to appear to be of approximately the same size. The horizontal length of fingers 32 is preferably slightly less than the depth of notch 36, and is preferably greater than the thickness of panel 14, to permit an interfitting knuckle connection 16 between adjacent panels, as described below.

Figure 6:
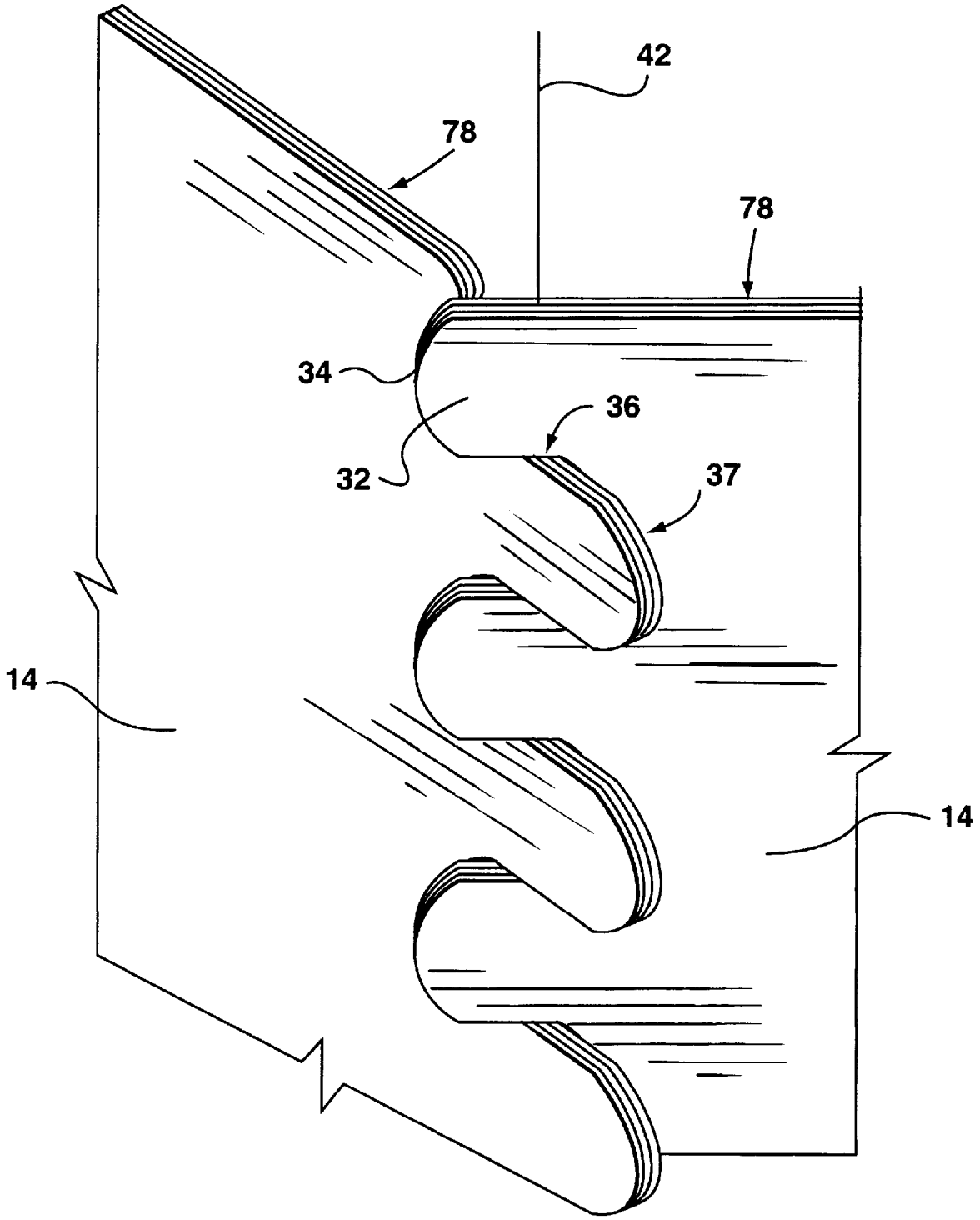
FIG. 6 is an enlarged partial reversed rear view of the assembly of FIG. 1, as shown in the area marked "6" in FIG. 1.

Connection 16 is made by inserting fingers 32 of one panel into the notches 36 of an adjacent panel, generally at the desired angle (see FIG. 6). Fingers 32 are inserted into notches 36 until front face 28 of a finger 32 engages back face 27 of the panel at root 37. To secure the connection, pins 42 are preferably inserted at top 20 and bottom 26. Pins 42 are described in more detail below.

Figure 19:
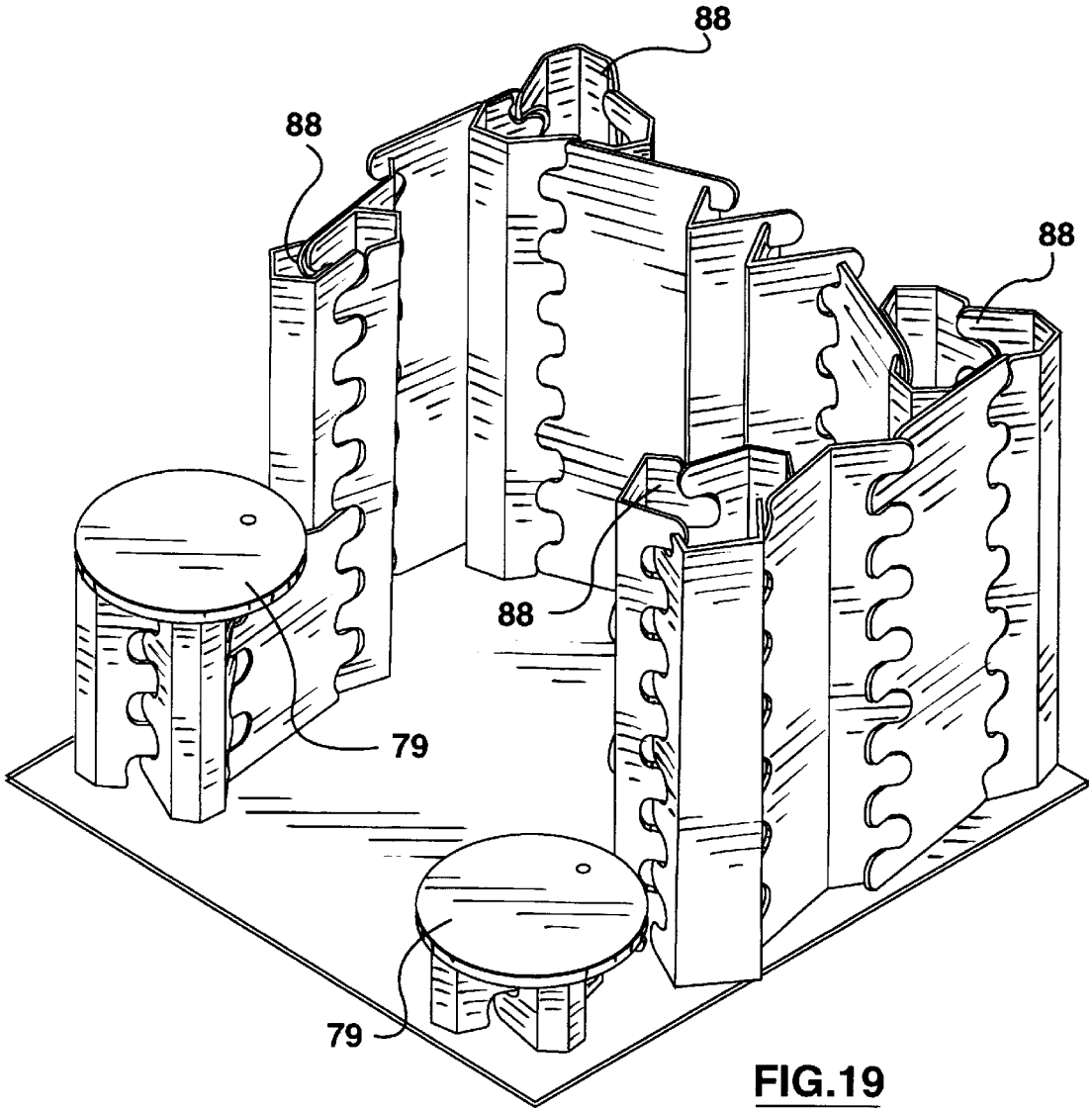
FIG. 19 is an isometric view of a fifth sample arrangement of an assembly of modular panel elements in accordance with the present invention.

Once fingers 32 have been inserted into corresponding notches 36 of an adjacent panel, the angle A between panels may be adjusted somewhat to suit the desired set-up of display assembly 10. An arrangement of panels 12 and 14 is chosen to suit the function and aesthetics of the desired display. In such an arrangement, it will be apparent that a plurality of intermediate panels 14 may be interconnected at various angles A to form an assembly 10, as demonstrated in the sample arrangements depicted in FIGS. 15–20. It will be apparent, however, that when fingers 32 are fully inserted into notches 36, as described above, a maximum angle A will be reached, angles larger than which will be prevented by the contact of front face 28 on finger 32 against back face 27 of the panel at root 37. It has be discovered that at this maximum angle A, which is usually about 135°, maximum support is transferred from one panel to another, which has a desirable stabilizing effect on display assembly 10. Accordingly, as shown in FIG. 19, and as will be better understood upon a complete reading of this description, a stable and sturdy display 10 is achieved best when every angle A between panels is approximately equal to 135°.

Figure 4:
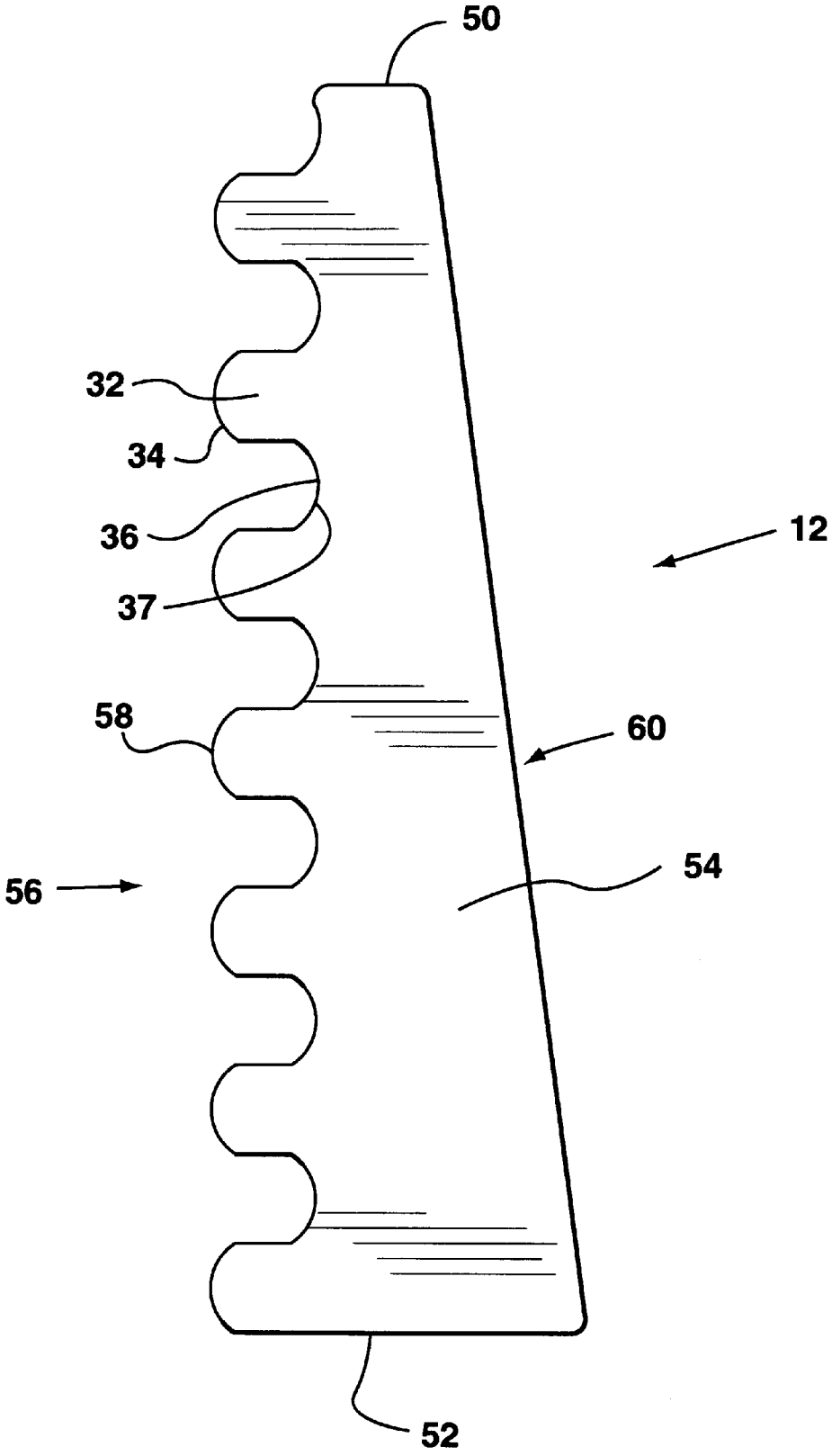
FIG. 4 is an isometric view of an alternate embodiment of the panel of FIG. 2.

Referring to FIG. 4, terminal panel 12 comprises a top 50, a bottom 52, has a central display portion 54, connecting side 56, with connecting means 58 thereon, and a finished side 60. As with intermediate panel 14, connecting means 58 comprises a plurality of spaced-apart fingers 32 with tips 34, and notches 36 with roots 37. With the exception of finished side 60, terminal panel 12 and intermediate panel 14 are essentially identical. It is to be understood that descriptions herein referring to panel 14 apply equally to a panel 12.

It will be understood that intermediate panels 14 need not have an overall rectangular shape, nor must sides 22 and 24 and connecting means 30 be vertically oriented. Furthermore, it will be apparent that terminal panels 12 may also have any shape desired (see, for example, FIG. 1). Furthermore, in will be understood that panels 12 need not be restricted to use as a wall element. Referring briefly to FIGS. 15–20, several alternate configurations are disclosed for use as table legs, columns, etc.

Figure 5:
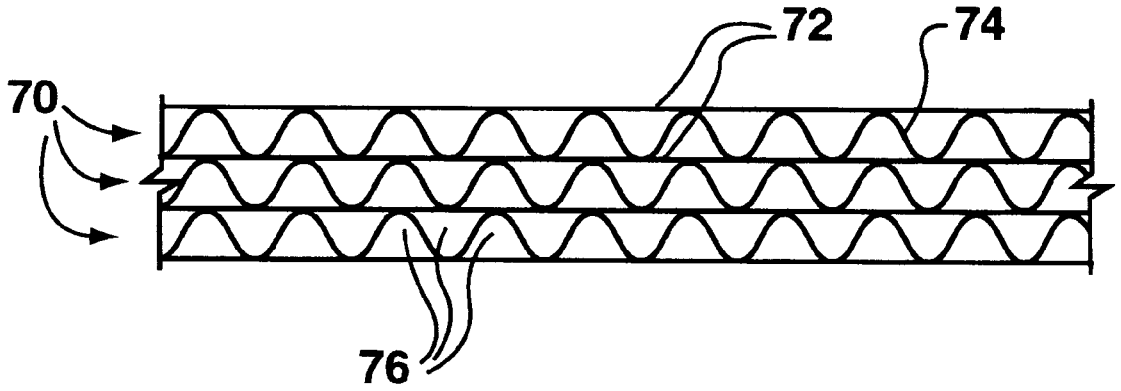
FIG. 5 is a partial sectional view of the panel of FIG. 2, taken along line 5—5.

Panels 12 and 14 are fabricated from multiple plies 70 of corrugated cardboard, laminated face-to-face, as shown in FIG. 5. Such multi-ply corrugate is commercially available under the trade marks TRI-WALL (3-ply) from Weyerhaeuser Company and SPACEKRAFT (8-ply) from MacMillan Bloedel Limited. Each ply 70 comprises two face layers 72 with a corrugate layer 74 therebetween. Corrugate layer 74 has a plurality of straight, parallel flutes 76 running throughout the length of each ply 70. Adjacent plies 70 are preferably positioned such that corrugate flutes 76 are aligned and parallel, so that a panel 12 or 14 will have a coherent grain, as defined by the corrugate flutes 76, throughout its thickness. The corrugate flutes 76 in a panel 12 or 14 are preferably aligned with the longitudinal (ie. lengthwise) axis of the panel.

Panel elements 12 and 14 may be made of any number of plies 70 desired, however it has been found that 3-ply panels are sufficiently strong for most display board applications, however, in some instances where exceptional strength is required, 8-ply panels are also useful. Preferably, all panels 12 and 14 in an display board assembly 10 have the same thickness. (ie. the same number of plies 70).

Panels 12 and 14 are cut from boards of this multi-ply corrugated cardboard. Any method of cutting may be used, but nitrogen laser cutting and/or die cutting is preferred to yield a clean cut. As a result of cutting, sides 22 and 24, top 20 and bottom 26 have exposed corrugate surfaces 78, as shown in FIG. 6. Optionally, exposed corrugate surfaces on top 20, sides 22 and 24, and bottom 26 of panel 14 may be covered with a paper or uncorrugated cardboard facing (not shown), to both provide an aesthetically pleasing finished surface as well as to prevent debris from entering the exposed corrugate flutes. Additionally, the facing prevents any damage which may occur to exposed corrugate flutes 76. As corrugate cardboard achieves a significant amount of its strength and rigidity from the structure and shape of corrugate flutes 76, the protection of flutes 76 from damage and deformation is desirable.

To increase the safety and durability of the panels, a Class-A flame retardant varnish, such as CLEARCOAT II (a trade mark of Fire Research Corp.), is applied to the outer surfaces of panel 14, as well as sprayed into any exposed corrugate surfaces 78. The coating is primarily applied as a fire retardant and to strengthen the panel, as well as to protect the corrugated board from damage due to moisture and humidity. Once the coating is applied to the panels, the panels may be primed and painted, as desired. Preferably, water-based paints are used, to increase the overall recyclability of the panels, as described below. Panels may be painted and re-painted as desired, thereby increasing the reusability of panels 12 and 14 in display assemblies 10 of differing uses and designs.

Once finished, a decorative cladding may also be applied to the surface of a panel. For example, a horizontal surface to be used as a table top 79 (see FIGS. 19 and 20) may be given a sheet metal or other cladding for aesthetic and/or durability reasons.

Figure 7:
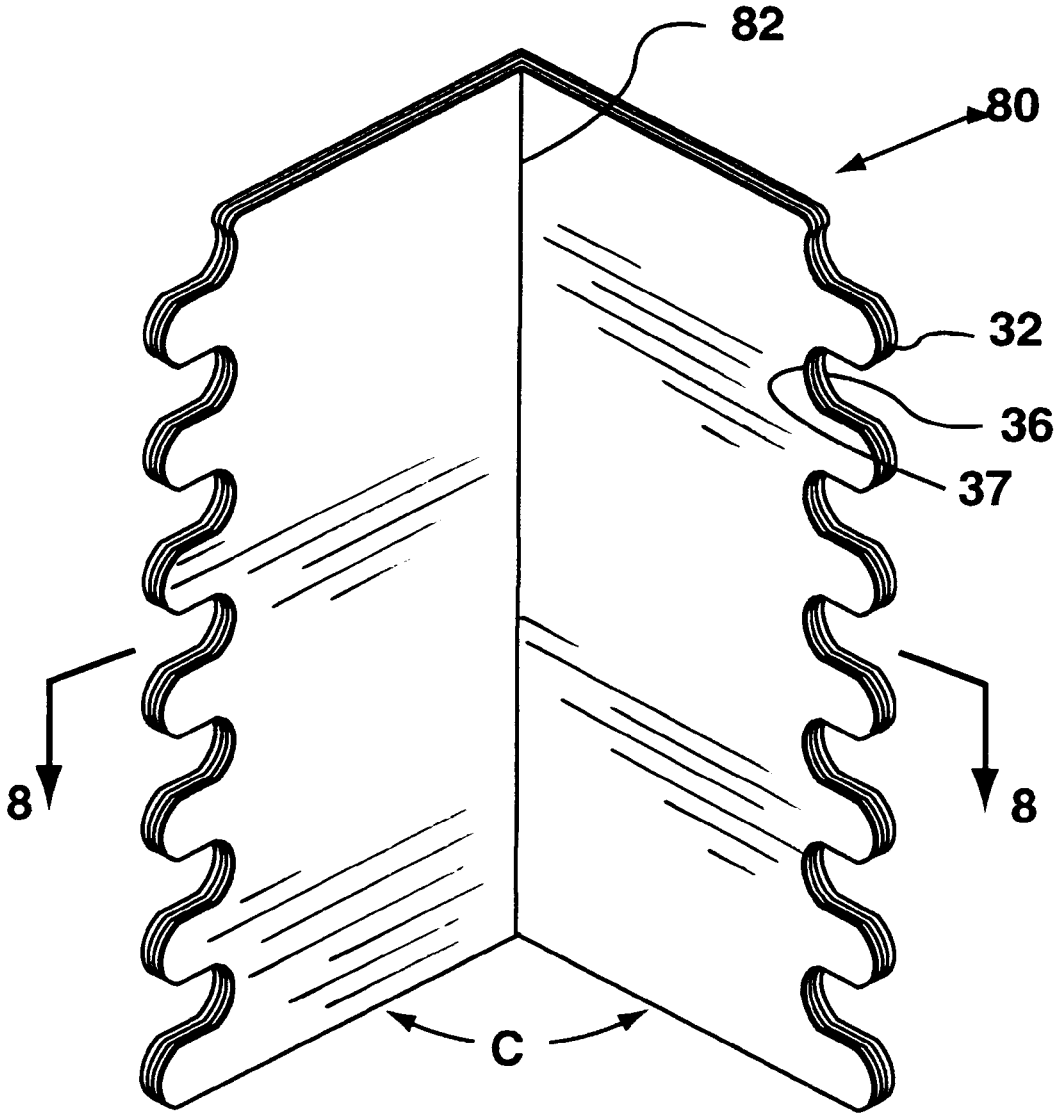
FIG. 7 is an isometric view of an alternate embodiment of the panel of FIG. 2.
Figure 8:
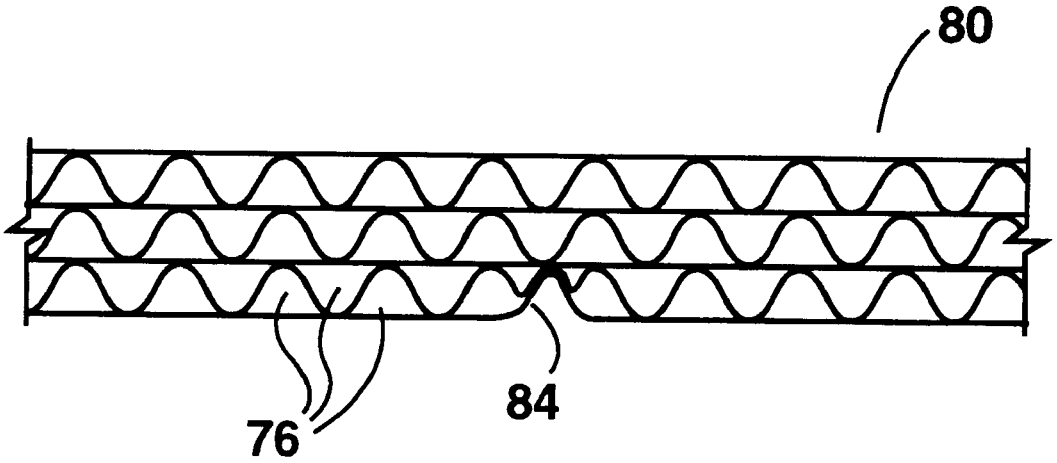
FIG. 8 is a partial sectional view of the panel of FIG. 7, prior to manual bending of the panel.

The panels of the present invention need not be planar. Referring to FIG. 7, a non-planar intermediate panel 80 having a linear bend 82 is shown. A non-planar panel 80 is made from an initially planar panel, as will now be described. Referring to FIG. 8, a linear crimp 84, formed by compressing one or more plies 70 of a planar panel, is made on panel 80 at the intended location of the inner corner of bend 82. Alternately, a score or cut (not shown) may be made into one or more plies 70 of panel 80 at the intended location of the inner corner of bend 82. Preferably, crimp 84 is located along the longitudinal axis of a corrugate flute 76. The depth of crimp 84 should be sufficient to penetrate at least one-third of the thickness of panel 80. Crimp 84 weakens panel 80 sufficiently to permit manual bending of panel 80 therealong. Any number of bends 82 may be made in a panel 80. In addition to forming non-planar panels 80, crimping may also be advantageously to form aesthetic elements as sleeve elements 110, described below, connection shrouds 86 (see FIGS. 18–20) and columns 88 (see FIGS. 19 and 20). It will be understood that the foregoing method of producing non-planar panel 80 applies only to lesser-ply panels, such as 3-ply panels, and is not generally feasible with greater-ply panels, such as 8-ply panels.

Figure 20:
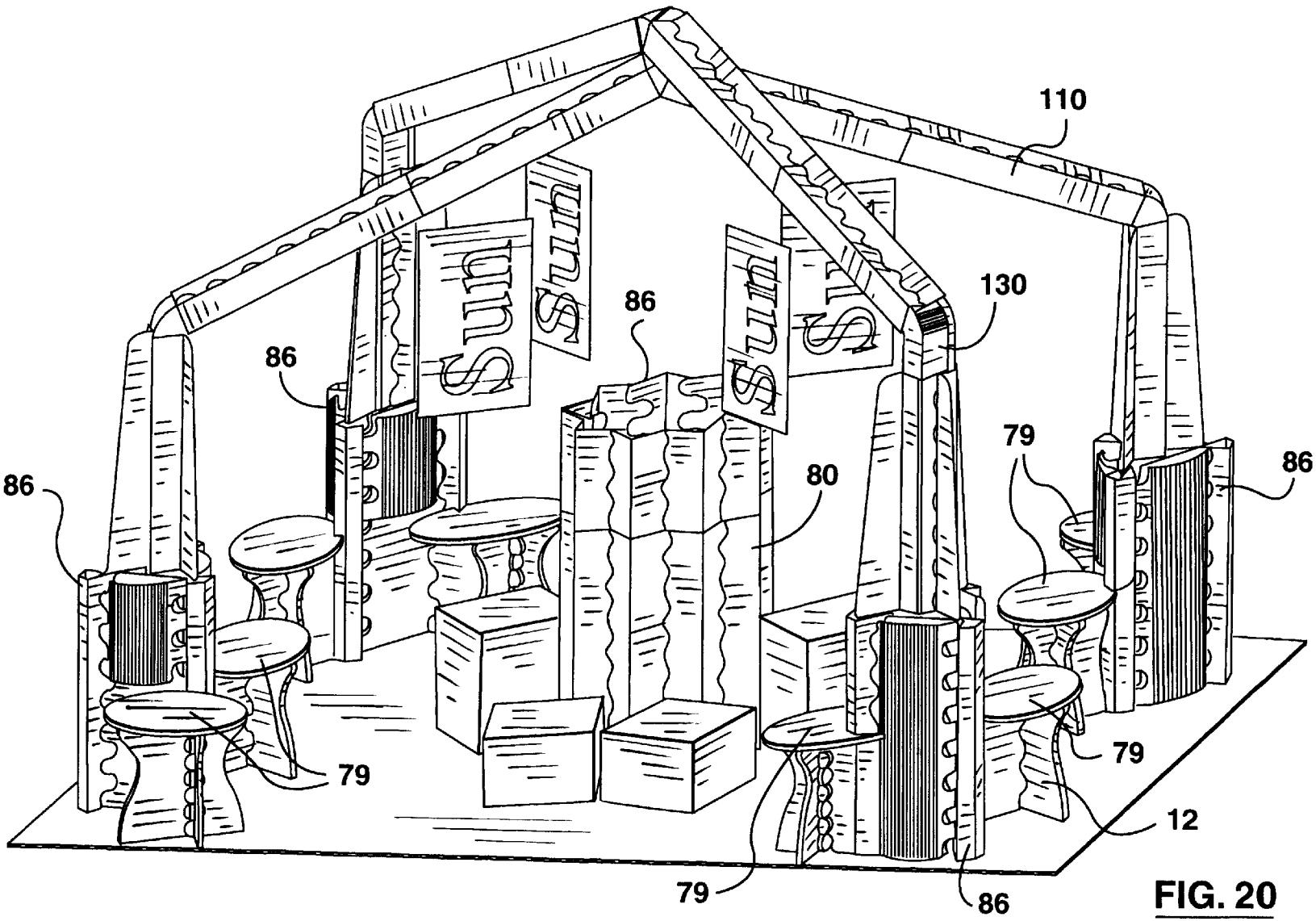
FIG. 20 is an isometric view of a sixth sample arrangement of an assembly of modular panel elements in accordance with the present invention.

Once crimped and bent into a non-planar panel 80, it will be understood that the non-planar nature of non-planar panel 80 is not fixed. In other words, angle C, as shown in FIG. 7, will not be constant. It will also be understood that the inherent resiliency of non-planar panel 80 will encourage non-planar panel 80 towards a more planar shape. Accordingly, as depicted in FIGS. 19 and 20, non-planar panels 80 are preferably arranged in a display assembly 10 such that the inherent resiliency of the panel urges angle A between adjacent panels towards the maximum possible angle A for connection 16 (as described above). This results in a more secure connection between panels, and a sturdier display assembly 10.

Figure 9:
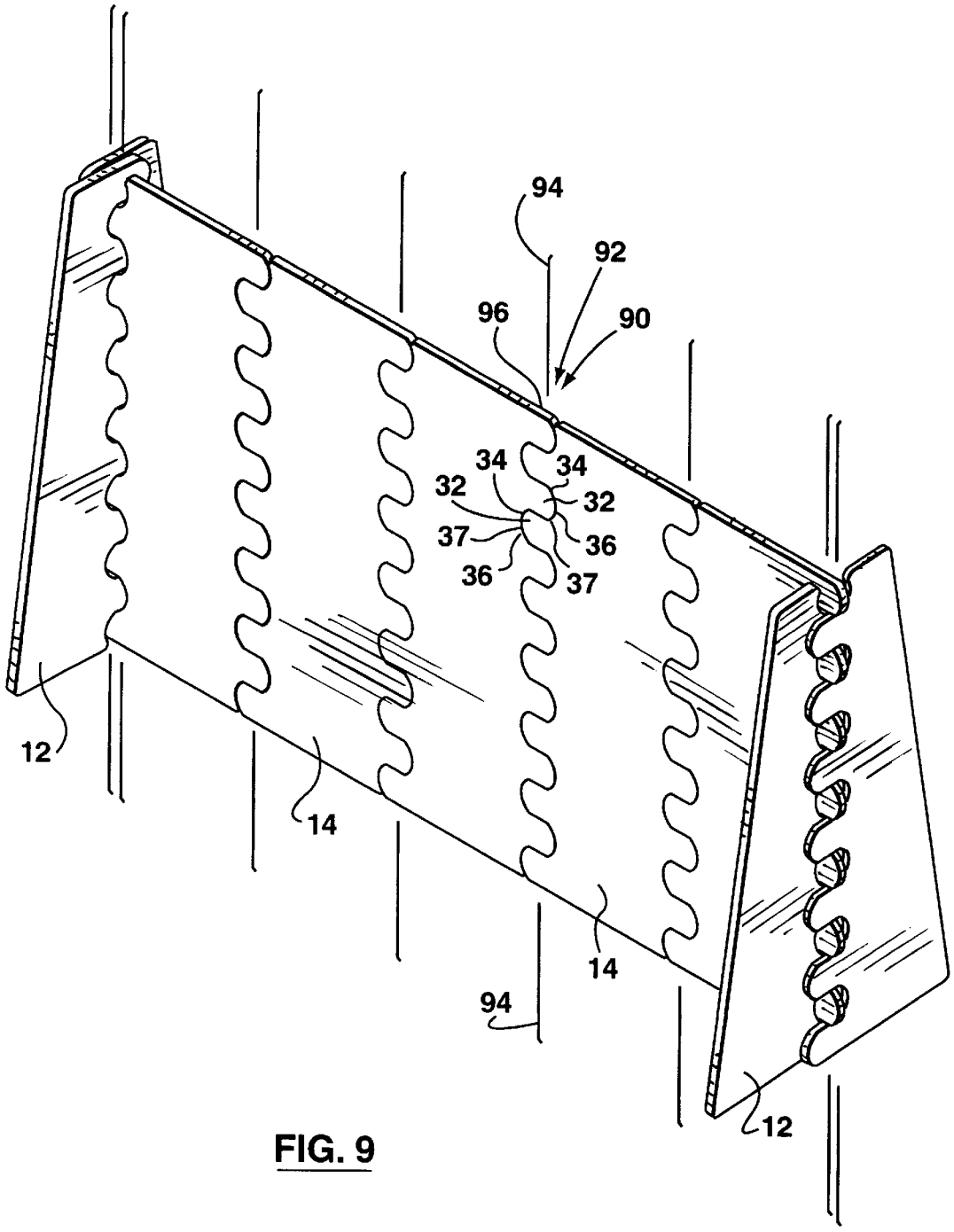
FIG. 9 is an isometric view of an alternate embodiment of the connecting means of the panel according to the present invention.

Referring to FIG. 9, an alternate embodiment of connection 16 is shown at 90. Alternate connection 90 comprises a hinge 92 comprising interfitting fingers 32 and notches 36, and hinge pins 94. In connection 90, fingers 32 are matingly interfitted in notches 36 such that tips 34 are immediately adjacent corresponding roots 37. Hinge pins 94 are located in longitudinal holes 96 through fingers 32. Advantageously, corrugate flutes 76 which run longitudinally throughout the length of the panel 80, as described above, may function as holes 96, if hinge pin 94 is chosen to be of smaller diameter than the width of corrugate flutes 76. Thus, no additional boring of hinge pin holes 96 will be required. Since flutes 76 run longitudinally through panels 14, flutes 76 in adjacent fingers 32 may simply be aligned and hinge pins 94 inserted therethrough to pin hinge connection 90. Hinge pins 94 must be inserted through a portion of the panels 14, but need not extend the entire length of panels 14. Pins 42, mentioned and referred to above, are constructed, installed and used in identical manner as hinge pins 94.

Figure 10:
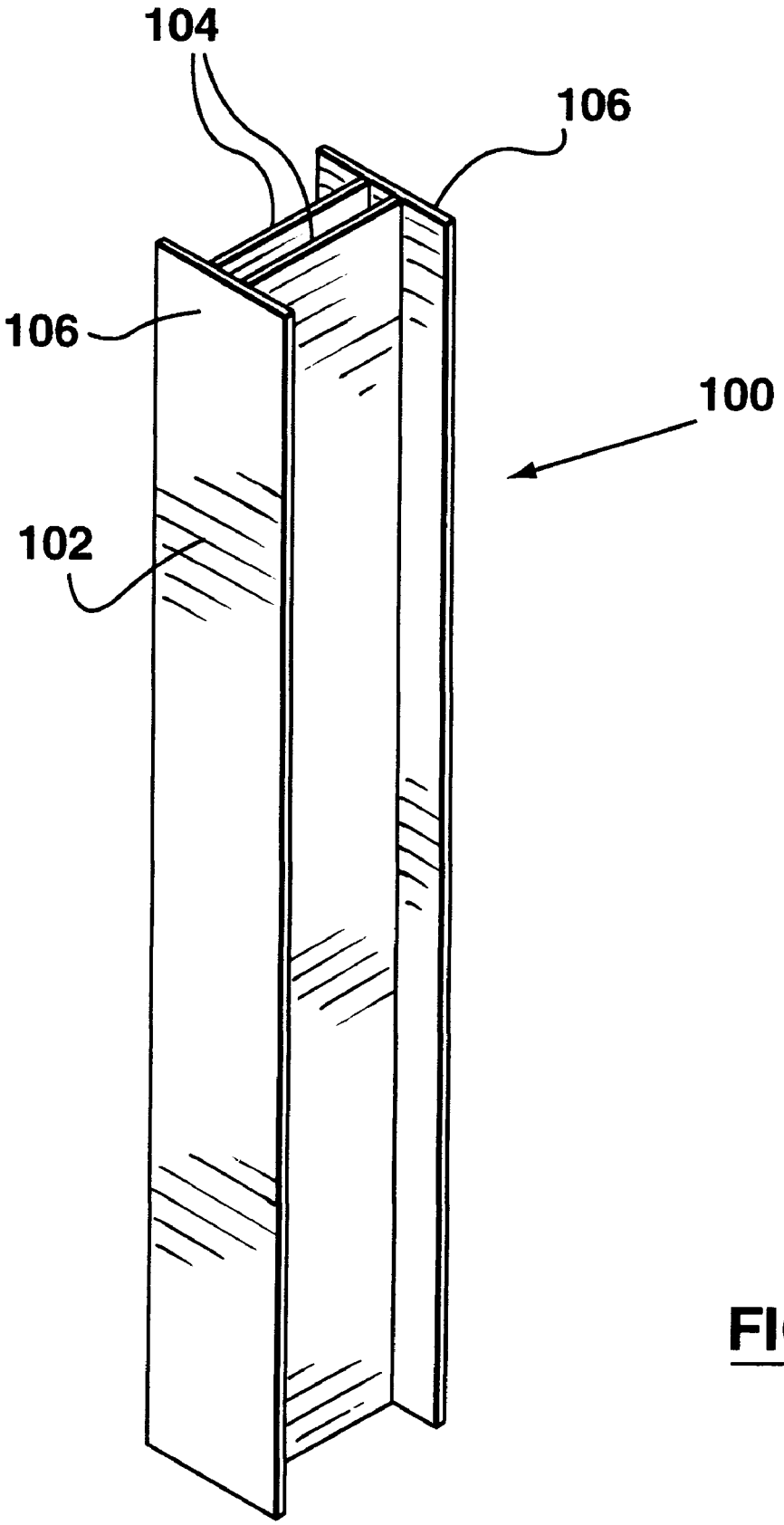
FIG. 10 is an isometric view of an alternate construction element according to the present invention.

Referring to FIG. 10, an additional construction element according to the present invention is shown at 100. Construction element 100 comprises a beam 102 having dual parallel web elements 104 and flanges 106. In order to maximize the strength of beam 102, the corrugate flutes 76 of web elements 104 and flanges 106 should be aligned to be parallel with the longitudinal axis to beam 102. Web elements 104 are connected to flanges 106 by gluing. A variety of beam sections are possible.

Figure 11:
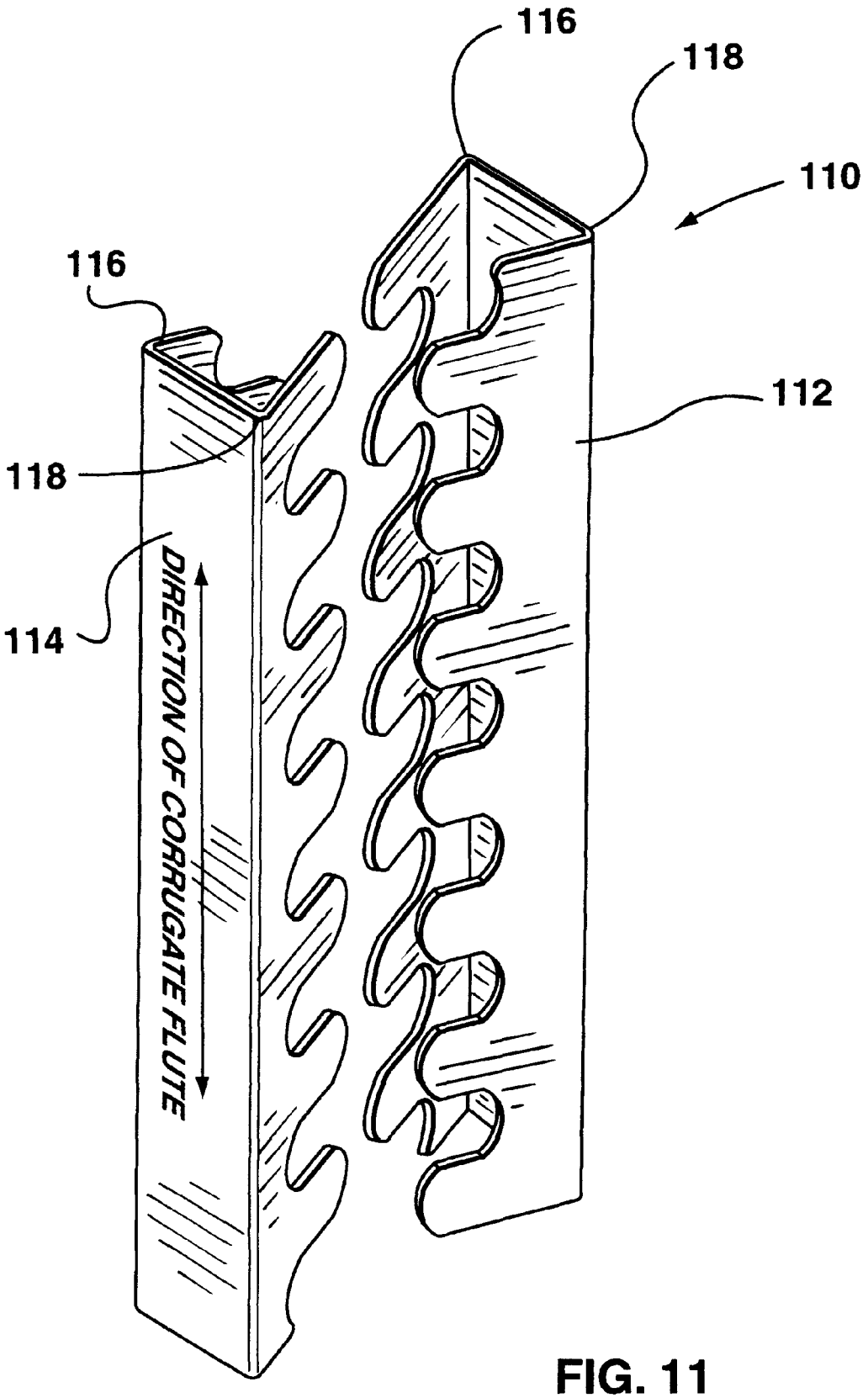
FIG. 11 is an isometric view of a sleeve for use with the construction element of FIG. 10.
Figure 12:
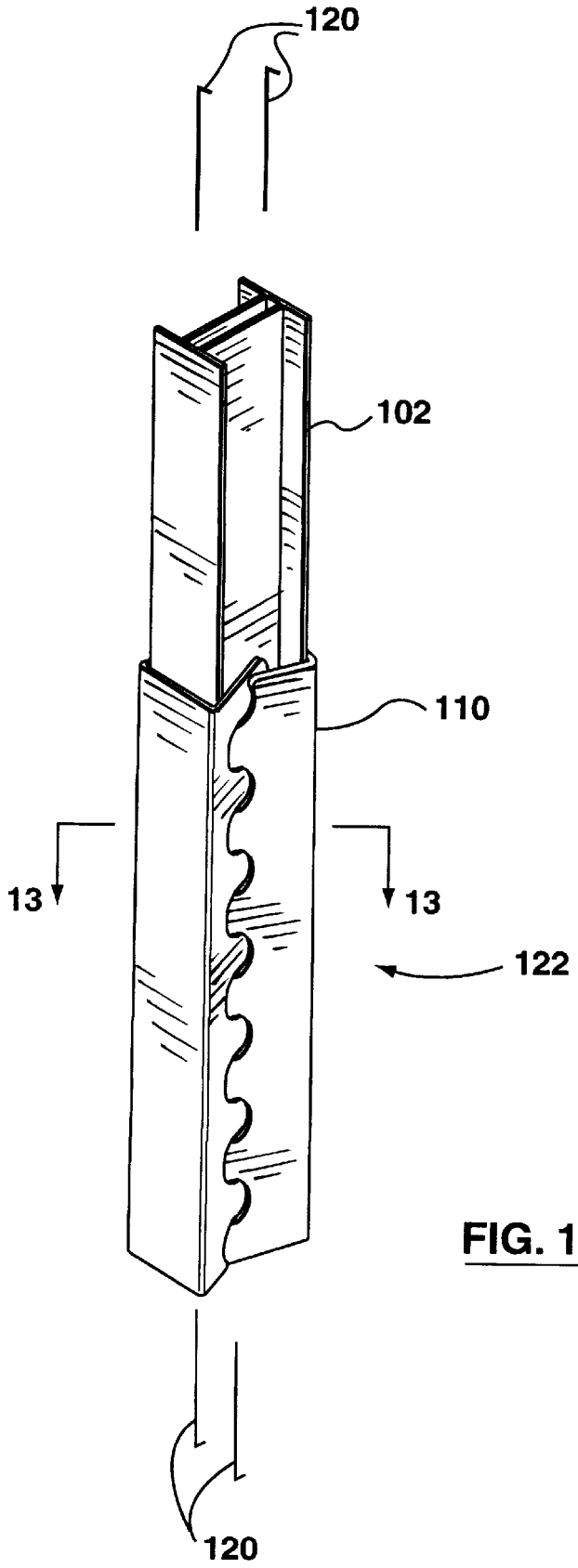
FIG. 12 is an isometric view of the assembly of the installation of the construction element of FIG. 10 inside the sleeve element of FIG. 11.

Referring to FIG. 11, a sleeve 110, comprising upper sleeve element 112 and lower sleeve element 114, is provided to optionally cover beam 102 to provide a more aesthetically interesting display. First and second sleeve elements 112 and 114 are formed from a planar panel by crimping as described above, at 116 and 118 to provide a U-shaped section. Fingers 32 interfit with fingers 32 on the mating sleeve element. The direction of the corrugate flute 76 is preferably longitudinally arranged in sleeve elements 112 and 114. As shown in FIG. 12, first and second sleeve elements 112 and 114 interfit to house beam element 102 compactly therein.

Referring to FIG. 12, first and second sleeve elements 112 and 114 are pinned together by the insertion of pins 120 through interfitted fingers 32. The size of pins 120 as chosen such that the pins 120 may be inserted into the aligned corrugate flutes 76 of fingers 32, in a manner as described above in respect of hinge connection 90. Pins 120 serve to align and maintain upper and lower sleeve elements 112 and 114 in place.

Figure 13:
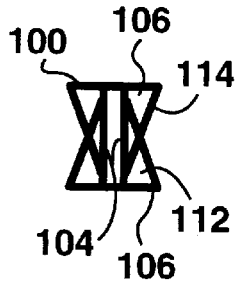
FIG. 13 is a sectional view of the sleeve of a FIG. 11 installed over the construction element of FIG. 10, taken along the lines 13—13.

Beam and sleeve assembly 122 is assembled as follows. Firstly, first and second sleeve elements 112 and 114 are interfitted together. Beam 102 is then inserted into assembled sleeve 110. Pins 120 are then inserted into aligned corrugate flutes 76 in fingers 32 through at least a portion of the length of sleeve 110. As shown in FIG. 13, the cross-sections of beam 102 and sleeve 110 are complementary and yield a compact beam and sleeve assembly 122.

Figure 14:
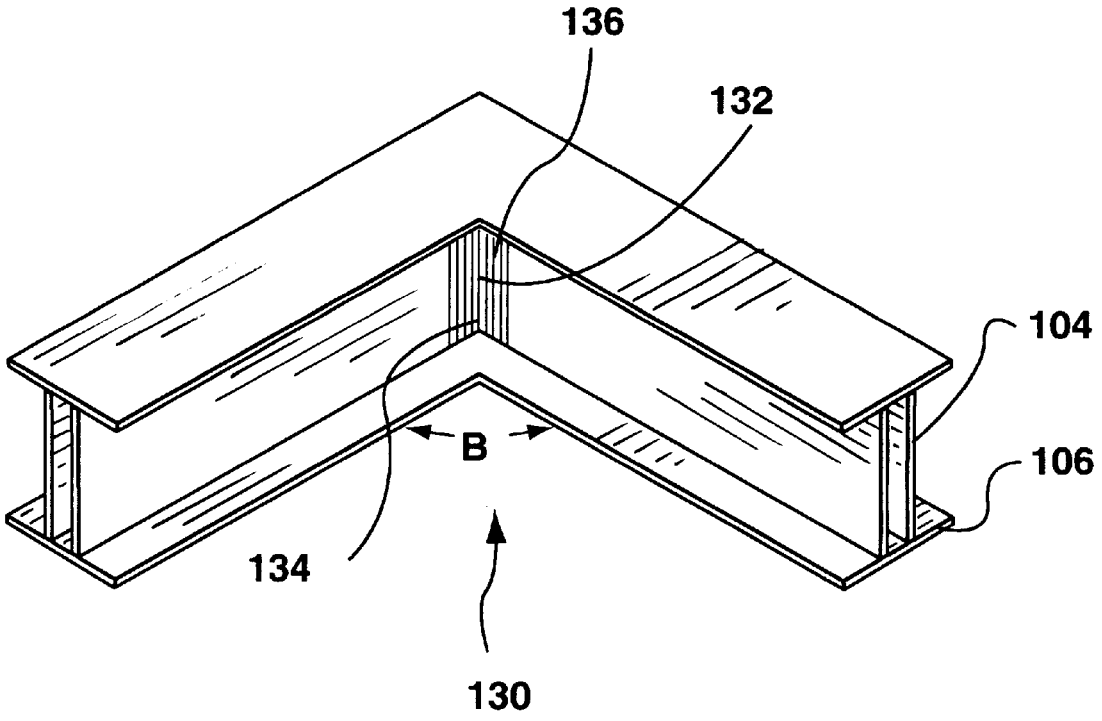
FIG. 14 is an isometric view of an alternate embodiment of the construction element of FIG. 10.

Referring to FIG. 14, a non-linear beam 130 is shown. Crimping may be advantageously used to provide alternate configurations of the beam 130, as will now be described. Non-linear beam 130, as with beam 102, comprises dual web elements 104 and flanges 106, and has a bend 132 having an inner corner 134. Web elements 104 are initially cut from flat board stock. A transverse (ie. widthwise) crimp 136 is made (as described above) in web elements 104 at the desired location of inner corner 134, which permits web element 104 to be manually bent to the desired shape. Flanges 106 are also cut from flat board stock so as to have the angle B required for beam 130. Web elements 104 and flanges 106 are then assembled and glued, as described above. Non-linear beams 130 of other configurations will be readily apparent to those skilled in the art. FIG. 20 depicts a non-linear beam 130 in use in a display assembly 10. It will be noted that beam 130 in FIG. 20 does not have a continuous flange 106 around bend 132. This demonstrates that the shape and configuration of a beam 130 (or 102) can be dictated by both aesthetic and structural concerns, leaving open many possibilities to the designer without departing from the scope of the present invention.

Advantageously, the panel and beam elements of the present invention can be interconnected in innumerable configurations and combinations to provide a variety of display assemblies 10 limited only by the imagination of the display designer. For illustration purposes, FIGS. 15–20 show panel and beam elements according to the present invention in use in various display configurations.

The panel and beam elements of the present invention offer several advantages over the prior art. The simple design and construction make the elements cheap and easy to manufacture from materials which are readily available. Advantageously, recycled materials may also be easily employed and, where only environmentally finishes such as water-based paints are applied to the display assembly elements, the elements are fully recyclable when no longer required. The resulting lightweight design permits easy installation and transportation. The integral connection means significantly reduces the number of parts required in a display assembly, thereby reducing costs of the display as well as expediting assembly and disassembly. Furthermore, the simplicity and formability of the material with which the panels and beam elements are made allows great latitude for creativity in a design of display assemblies.

It will be appreciated that many of benefits of the present invention can also be achieved with other lightweight construction materials, such as structural styrofoam and foam, as well as hollow-core plywood panels.

The durability and formability of the panels of the present invention also lend to their implementation with other uses perhaps more permanent than trade show displays, such as point-of-purchase merchandise displays in retail stores, as well as novel furniture and cabinet applications. It will be apparent to one skilled in the art that yet other applications of the present invention are possible, and fall within the scope of the claims below.

It is to be understood that what has been described are preferred embodiments to the invention. The invention nonetheless is susceptible to certain changes and alternative embodiments fully comprehended by the spirit of the invention as described above, and the scope of the claims set out below.

I claim:

1. A panel assembly comprising:

a first panel connected to a second panel, said first and second panels each having a body made of corrugated board, said body having a front face and a back face, said corrugated board defining a plurality of parallel flutes disposed between said front face and said back face, and a plurality of fingers and notches alternately defined in said body to define a connecting side, said fingers and said notches being aligned along an axis that is coaxial with at least one of said flutes; and at least one pin for securing said first and second panels together;

wherein said first panel is connected to said second panel with said fingers and said notches interfitting with each other, and wherein said flutes define at least one through channel between said interfitted fingers and notches, and wherein said at least one pin extends at least partly through said at least one through channel to secure together at least some of said interfitted fingers and notches.

2. A panel assembly as claimed in claim 1 wherein said fingers and said notches are sufficiently sized to permit said interfit to be at close tolerances.

3. A panel assembly as claimed in claim 1 wherein said fingers and said notches have complementary profiles.

4. A panel assembly as claimed in claim 1 wherein the corrugated board has multiple plies.

5. A panel assembly as claimed in claim 1 wherein said second panel has two of said connecting sides to facilitate attachment of said first panel on one of said connecting sides and another of said panels on the other of said connecting sides.

6. A panel assembly as claimed in claim 1 wherein at least one of said panels is non-planar.

7. A panel assembly as claimed 1 wherein at least one of said panels has been treated with a flame retardant.

8. A panel assembly as claimed in claim 1 wherein at least some of said fingers have rounded tips.

9. A panel assembly as claimed in claim 1 wherein at least one of said panels further comprises at least one bend line defined in at least one of said front face and said back face to facilitate bending said panel along the line of said bend line.

10. A panel assembly kit comprising:

a plurality of panels, said panels having a body made of corrugated board, said body having a front face and a back face, said corrugated board defining a plurality of parallel flutes disposed between said front face and said back face, and a plurality of fingers and notches alternately defined in said body to define a connecting side, said fingers and said notches being aligned along an axis that is coaxial with at least one of said flutes; and a plurality of pins for securing said panels together;

wherein said panels are assembled by interfitting said fingers and said notches of one said panel with said fingers and said notches on another said panel, said flutes defining at least one through channel between at least some of said interfitted fingers and notches for receiving at least one of said pins to secure said panels together.

11. A panel assembly as claimed in claim 10 wherein said fingers and said notches are sufficiently sized to permit said interfit to be at close tolerances.

12. A panel assembly kit as claimed in claim 10 wherein the corrugated board has multiple plies.

13. A panel assembly kit as claimed in claim 10 wherein at least one of said panels has two of said connecting sides.

14. A panel assembly kit as claimed in claim 10 wherein at least one of said panels has been treated with a flame retardant.

15. A panel assembly kit as claimed in claim 10 wherein at least some of said fingers on said panels have rounded tips.

16. A panel assembly kit as claimed in claim 10 wherein at least one of said panels further comprises at least one bend line defined in at least one of said front face and said back face to facilitate bending of said panel along the line of said bend line.

* * * * *